US010867763B1

(12) United States Patent
Werries

(10) Patent No.: US 10,867,763 B1
(45) Date of Patent: Dec. 15, 2020

(54) SHAPE-MEMORY-BASED DEAD-FACING MECHANISMS FOR SEVERING ELECTRICAL CONNECTIONS

(71) Applicant: Raytheon Company, Waltham, MA (US)

(72) Inventor: William D. Werries, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 16/423,384

(22) Filed: May 28, 2019

(51) Int. Cl.
*H01H 37/32* (2006.01)
*H01H 37/64* (2006.01)
*H01H 37/46* (2006.01)

(52) U.S. Cl.
CPC ..... *H01H 37/323* (2013.01); *H01H 37/64* (2013.01); *H01H 37/46* (2013.01)

(58) Field of Classification Search
CPC ..... H01H 37/323; H01H 37/64; H01H 37/46
USPC ..... 337/399
See application file for complete search history.

(56) References Cited

U.S. PATENT DOCUMENTS 3,725,835 A 4/1973 Hopkins et al.
3,991,649 A 11/1976 Patrichi
4,618,755 A 10/1986 Wallace
4,713,643 A * 12/1987 Baum ..... H01H 71/145 337/140
5,184,269 A * 2/1993 Shimada ..... H01H 81/02 337/3
5,629,662 A * 5/1997 Floyd ..... H01H 71/145 337/36
6,917,276 B1 7/2005 Menard et al.
7,064,636 B1 * 6/2006 Walz ..... H01H 83/20 335/18
8,418,455 B2 4/2013 Lyman et al.
10,062,537 B1 8/2018 Vega
2003/0063419 A1 * 4/2003 Nemir ..... H02H 3/05 361/78

(Continued)

FOREIGN PATENT DOCUMENTS

DE 3005470 A1 7/1981

OTHER PUBLICATIONS

International Search Report and Written Opinion of the International Searching Authority in connection with International Patent Application No. PCT/US2019/064735 dated Mar. 20, 2020, 14 pages.

(Continued)

*Primary Examiner* — Stephen S Sul

(57) ABSTRACT

An apparatus includes an electrical switch that includes (i) multiple first electrical contacts and (ii) a second electrical contact configured to bridge the first electrical contacts in order to form at least one electrical connection. The apparatus also includes a shape-memory actuator configured to move the second electrical contact in order to selectively open the electrical switch and break the at least one electrical connection. The shape-memory actuator may be configured to be returned to an original shape and the second electrical contact may be configured to be returned to a bridging position in order to reset the apparatus. The apparatus may further include a shutter member configured to be moved between the first electrical contacts in order to prevent re-bridging of the first electrical contacts and to extend an arc-gap between the first electrical contacts.

20 Claims, 7 Drawing Sheets

(56) References Cited

U.S. PATENT DOCUMENTS

| | | | | |
|---|---|---|---|---|
| 2008/0002313 | A1* | 1/2008 | DiSalvo | H02H 3/335 361/42 |
| 2009/0147417 | A1* | 6/2009 | Goodsell | H01H 83/04 361/42 |
| 2011/0234362 | A1* | 9/2011 | Koehler | H01H 37/323 337/290 |
| 2014/0312061 | A1* | 10/2014 | Marone | H01H 61/066 134/93 |
| 2015/0243463 | A1* | 8/2015 | Mills | H01H 61/0107 337/139 |
| 2016/0163488 | A1* | 6/2016 | Maloney | H01H 9/38 335/15 |
| 2016/0217954 | A1 | 7/2016 | Koehler et al. | |
| 2016/0307718 | A1* | 10/2016 | Geier | H01H 61/0107 |
| 2016/0314918 | A1* | 10/2016 | Skurkis | H01H 37/323 |
| 2016/0327216 | A1* | 11/2016 | Gielen | F21K 9/278 |
| 2019/0228939 | A1* | 7/2019 | Chiu | H01H 61/0107 |

OTHER PUBLICATIONS

Samtec, Inc., "Modified .025 Sq. Post Headers," Specification sheet, Oct. 2018, 2 pages.
Samtec, Inc., "Cost-Effective Reliable Socket," Specification sheet, Dec. 2018, 1 page.
Samtec, Inc., "Tiger Claw Pass-Through Socket," Specification sheet, Oct. 2018, 1 page.
Tini Aerospace, Inc., "Cable Cutter," printed May 6, 2019, 6 pages.

* cited by examiner

SHAPE-MEMORY-BASED DEAD-FACING MECHANISMS FOR SEVERING ELECTRICAL CONNECTIONS

TECHNICAL FIELD

This disclosure relates generally to electrical systems. More specifically, this disclosure relates to shape-memory-based dead-facing mechanisms for severing electrical connections.

BACKGROUND

In various applications, it may be necessary or desirable to sever communication cables, power cables, or other types of electrical connections. For example, flight vehicles such as drones, missiles, or rockets often are used with or include umbilical cables that connect the flight vehicles to other devices or systems prior to launch. If an umbilical cable remains attached to a flight vehicle during flight, ionized air and conductive exhaust gasses can flow over the umbilical cable and induce destructive electrical currents in the umbilical cable. These electrical currents can cause catastrophic failures in electronic devices that are attached to the umbilical cable and can cause upsets in other nearby electronic devices.

SUMMARY

This disclosure provides shape-memory-based dead-facing mechanisms for severing electrical connections.

In a first embodiment, an apparatus includes an electrical switch that includes (i) multiple first electrical contacts and (ii) a second electrical contact configured to bridge the first electrical contacts in order to form at least one electrical connection. The apparatus also includes a shape-memory actuator configured to move the second electrical contact in order to selectively open the electrical switch and break the at least one electrical connection.

In a second embodiment, a system includes at least one electrical component coupled to one or more electrical connections and at least one shape-memory-based circuit interrupter configured to selectively break the one or more electrical connections. Each shape-memory-based circuit interrupter includes an electrical switch that includes (i) multiple first electrical contacts and (ii) a second electrical contact configured to bridge the first electrical contacts in order to form at least one of the one or more electrical connections. Each shape-memory-based circuit interrupter also includes a shape-memory actuator configured to move the second electrical contact in order to selectively open the electrical switch and break the at least one electrical connection.

In a third embodiment, a method includes forming at least one electrical connection through an electrical switch of a shape-memory-based circuit interrupter. The electrical switch includes (i) multiple first electrical contacts and (ii) a second electrical contact configured to bridge the first electrical contacts in order to form the at least one electrical connection. The method also includes, using a shape-memory actuator of the shape-memory-based circuit interrupter, moving the second electrical contact in order to selectively open the electrical switch and break the at least one electrical connection.

Other technical features may be readily apparent to one skilled in the art from the following figures, descriptions, and claims.

BRIEF DESCRIPTION OF THE DRAWINGS

For a more complete understanding of this disclosure, reference is made to the following description, taken in conjunction with the accompanying drawings, in which.

DETAILED DESCRIPTION

Figure 1A:
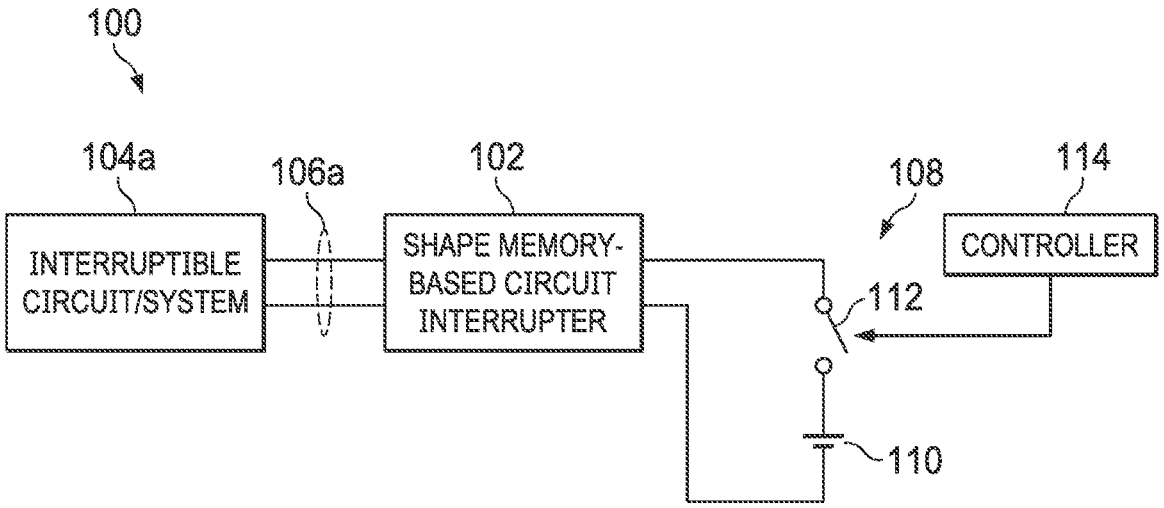
FIGS. 1A and 1B illustrate example systems having shape-memory-based dead-facing mechanisms according to this disclosure.

FIGS. 1A through 4, described below, and the various embodiments used to describe the principles of the present invention in this patent document are by way of illustration only and should not be construed in any way to limit the scope of the invention. Those skilled in the art will understand that the principles of the present invention may be implemented in any type of suitably arranged device or system.

As noted above, it may be necessary or desirable to sever communication cables, power cables, or other types of electrical connections in various situations. For example, it is often necessary or desirable to sever umbilical cables coupled to flight vehicles during or after launch. Severing the umbilical cables can help to prevent the creation of destructive electrical currents in the umbilical cables, which can be caused by ionized air and conductive exhaust gasses flowing over or around the umbilical cables.

One prior approach for severing umbilical cables has involved the use of pyrotechnically-activated severing or "dead-facing" mechanisms near control electronics. These mechanisms typically include a blade and a small pyrotechnic charge. When the pyrotechnic charge is triggered, the resulting force moves the blade towards a cable and physically severs the cable. Unfortunately, the use of pyrotechnic charges often imposes special handling requirements on dead-facing mechanisms and typically requires the presence of special triggering circuitry and safety circuitry in the dead-facing mechanisms. Also, the use of pyrotechnic charges can prevent the testing of dead-facing mechanisms, such as during assembly, since dead-facing mechanisms that use pyrotechnic charges are hardware-destructive and cannot simply be reset. In addition, the use of pyrotechnic charges can itself create debris, short-circuits, or other problems in a flight vehicle or other system.

This disclosure provides various shape-memory-based dead-facing mechanisms, each of which includes one or more electrical switches. Each electrical switch may be formed using multiple stationary electrical contacts and a movable electrical contact that can electrically connect or "bridge" the stationary electrical contacts. A shape-memory actuator is configured to reposition the movable electrical contact, such as when the shape-memory actuator expands or contracts once triggered to move the movable electrical contact. When triggered, the shape-memory actuator can reposition the movable electrical contact so that the stationary electrical contacts are no longer bridged, thereby interrupting an electrical circuit that includes the stationary electrical contacts. In addition, a shutter member can be moved between the stationary electrical contacts.

In this way, each shape-memory-based dead-facing mechanism can help to physically separate or "dead-face" portions of an electrical connection, such as an electrical cable, by repositioning its movable electrical contact so that its stationary electrical contacts are no longer bridged. This allows the shape-memory-based dead-facing mechanisms to sever electrical connections quickly and easily. Also, this is accomplished using a shape-memory actuator, which in some embodiments can be driven by simple, non-safety circuitry. Further, the shutter member helps to prevent re-engagement of the movable electrical contact, thereby helping to avoid the inadvertent re-bridging of the stationary electrical contacts. The shutter member also helps to extend the arc-gap between the stationary electrical contacts, thereby reducing the likelihood of electrical arcs (unwanted conduction paths) between the unbridged stationary electrical contacts. Beyond that, the shape-memory-based dead-facing mechanisms can be easily reset, such as by re-compressing or otherwise resetting the shape-memory actuator. This allows the mechanisms to be tested (such as for both open and closed functions) during design or assembly or at other times and then reset as needed. In addition, the shape-memory-based dead-facing mechanisms can produce no explosive or other residues or debris, and no unsecured parts of the shape-memory-based dead-facing mechanisms may be allowed to contact or damage other components. Finally, the shape-memory-based dead-facing mechanisms may be cheaper to obtain, install, and replace compared to pyrotechnically-activated dead-facing mechanisms, and the number of shape-memory-based dead-facing mechanisms used in a given application can be easily scaled for a desired number of electrical connections.

Figure 1B:
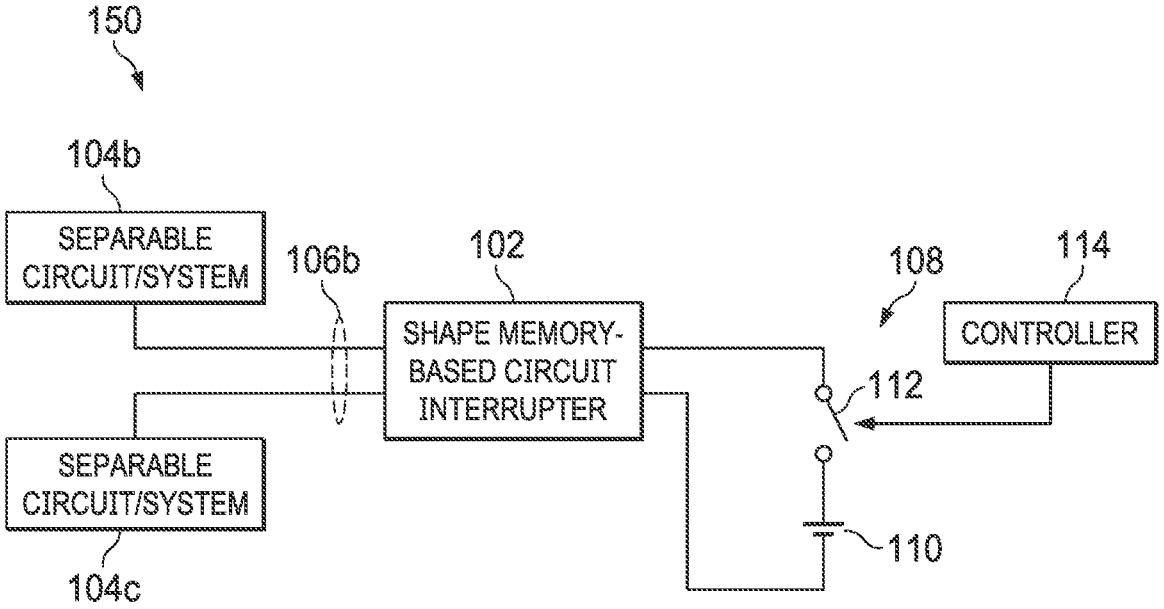

FIGS. 1A and 1B illustrate example systems 100 and 150 having shape-memory-based dead-facing mechanisms according to this disclosure. As shown in FIG. 1A, the system 100 includes a shape-memory-based circuit interrupter 102, which is coupled to an interruptible circuit or system 104*a*. As described in more detail below, the shape-memory-based circuit interrupter 102 includes an electrical switch and a shape-memory actuator. When triggered, the shape-memory actuator opens the electrical switch to interrupt at least one electrical path 106*a* associated with the interruptible circuit or system 104*a*.

The shape-memory-based circuit interrupter 102 includes any suitable structure that uses a shape-memory actuator configured to selectively open an electrical switch. In some embodiments, the electrical switch includes stationary electrical contacts and a movable electrical contact, where the movable electrical contact bridges the stationary electrical contacts until repositioned by the shape-memory actuator. Also, in some embodiments, the electrical switch further includes a shutter member that can be positioned between the stationary electrical contacts. Example embodiments of the shape-memory-based circuit interrupter 102 are provided below, although these embodiments are for illustration only.

The interruptible circuit or system 104*a* includes any suitable circuit, device, or other structure having at least one electrical component that is coupled to a selectively-interruptible electrical path 106*a*. The interruptible circuit or system 104*a* may include any suitable electrical or electronic device or devices that transmit or receive one or more data, power, or other signals over the electrical path 106*a*. The electrical path 106*a* includes one or more cables, wires, or other conductive pathways for one or more electrical signals.

An activation circuit 108 is used to trigger the shape-memory actuator of the shape-memory-based circuit interrupter 102 in order to sever the at least one electrical path 106*a*. The activation circuit 108 includes any suitable structure configured to heat or otherwise trigger a shape-memory actuator of a shape-memory-based circuit interrupter 102. In some embodiments, for example, the activation circuit 108 includes a power source 110 and a switch 112 that are coupled in series with the shape-memory actuator of the shape-memory-based circuit interrupter 102. When the switch 112 is closed, an electrical current from the power source 110 flows through the shape-memory actuator, which heats the shape-memory actuator and causes the shape-memory actuator to change shape. Thus, the activation circuit 108 can be implemented easily, without requiring the presence of special safety circuitry or triggering circuitry. Note, however, that the activation circuit 108 can be implemented in any other suitable manner. For instance, the activation circuit 108 may include any other suitable mechanism to heat the shape-memory actuator of a shape-memory-based circuit interrupter 102 in order to trigger the severing of an electrical path 106*a*. Also, while not required, safety circuitry may be used as part of the activation circuit 108.

In this example, a controller 114 can be used to (among other things) control the activation circuit 108, such as by controlling whether the switch 112 is opened or closed. The controller 114 can also perform other control operations, such as by controlling one or more operations of the interruptible circuit or system 104*a* or a larger device or system that includes the interruptible circuit or system 104*a*. The controller 114 includes any suitable structure for controlling at least the operation of an activation circuit 108. For instance, the controller 114 may include one or more microprocessors, microcontrollers, digital signal processors (DSPs), field programmable gate arrays (FPGAs), application specific integrated circuits (ASICs), or discrete circuitry.

As shown in FIG. 1B, the system 150 also includes the shape-memory-based circuit interrupter 102, which is coupled to the activation circuit 108. The activation circuit 108 in this example is implemented using the power source 110 and the switch 112, and the switch 112 can be controlled by the controller 114. These components may operate in the same or similar manner as described above with respect to FIG. 1A.

In the example shown in FIG. 1B, the shape-memory-based circuit interrupter 102 when triggered interrupts at least one electrical path 106*b* that extends between at least two severable circuits or systems 104*b*-104*c*, each of which has at least one electrical component that is coupled to the electrical path 106*b*. Here, the separable circuits or systems 104*b*-104*c* can communicate one or more data, power, or other signals between one another as long as the shape-memory-based circuit interrupter 102 is not triggered. Once triggered, the shape-memory-based circuit interrupter 102 severs the electrical path 106*b*, separating the separable circuits or systems 104*b*-104*c* from one another. If one of the separable circuits or systems 104*b*-104*c* is providing power to the other, this may cause the other severable circuit or system 104*b*-104*c* to stop functioning. At a minimum, triggering the shape-memory-based circuit interrupter 102 stops the communication of electrical signals between the separable circuits or systems 104*b*-104*c*.

As noted above, in some embodiments, each shape-memory-based circuit interrupter 102 can help to physically sever at least one electrical connection, such as an electrical cable, by repositioning a movable electrical contact so that stationary electrical contacts are no longer bridged. Also, each shape-memory-based circuit interrupter 102 may move a shutter member between the stationary electrical contacts, helping to prevent re-engagement of the movable electrical contact and extending the arc-gap between the stationary electrical contacts. In addition, each shape-memory-based circuit interrupter 102 may be easily reset, such as by re-compressing or otherwise resetting the shape-memory actuator. In some instances, this resetting can be accomplished without requiring any replacement parts for the shape-memory-based circuit interrupter 102.

As can be seen here, the shape-memory-based circuit interrupter 102 can be used in various ways to interrupt one or more electrical paths involving one or more circuits or systems. This type of functionality can find use in a number of applications. For example, one or more shape-memory-based circuit interrupters 102 may be used with a drone, missile, rocket, plane, or other flight vehicle. As a particular example, one or more shape-memory-based circuit interrupters 102 may be used to sever or otherwise interrupt one or more electrical pathways between an umbilical cable and internal hardware within the flight vehicle. As a result, even if the umbilical cable remains attached to the flight vehicle during flight, no destructive electrical currents can be transferred from the umbilical cable to the internal hardware within the flight vehicle. As another particular example, a flight vehicle or launcher may need to isolate its connections to one or more mounting points where stores are carried, such as during an emergency ejection of part or all of a carriage system. One or more shape-memory-based circuit interrupters 102 may be used to sever or otherwise interrupt one or more electrical pathways involving any exposed cables until safely restored by a ground crew or maintenance crew. The ability to reset each shape-memory-based circuit interrupter 102 after use allows the circuit interrupter 102 to be tested, such as during assembly or inspection of a flight vehicle, in a non-destructive manner.

As another example application, a secure data, secure communications, or other protected facility may use one or more shape-memory-based circuit interrupters 102 to control data transfers or other communications into or out of the protected facility. If a data breach or other security concern arises, the one or more shape-memory-based circuit interrupters 102 may be triggered (possibly automatically) to stop the flow of data or other communications into or out of the protected facility. This may be useful in secure, classified, or other sensitive installations, such as military or national intelligence centers, banking centers, or server farms. A particular example use of this functionality is in a Secure Compartmentalized Information Facility (SCIF) area of a building or other location used to process or store classified or other protected information. The ability to reset each shape-memory-based circuit interrupter 102 after use allows the re-establishment of data transfers or other communications into or out of the protected facility.

As yet another example application, a building, ship/vessel, or other fixed or movable structure may use one or more shape-memory-based circuit interrupters 102 to isolate any damaged areas of the structure. The ability to isolate damaged areas of a structure can help to allow restoration of network or other communication services more quickly and easily. A particular use of this functionality is for battle damage isolation or other damage isolation in military or commercial ships or other vessels, where there may be a need or desire to isolate electrical pathways through damaged portions of a vessel to help restore power, data transfers, or communications around the damaged portions of the vessel.

Note that these example applications are for illustration only and that a number of other possible applications may find use for one or more shape-memory-based circuit interrupters 102. In general, one or more shape-memory-based circuit interrupters 102 may be used in any application where secure and positive isolation of one or more data, power, or other signals in the event of an emergency or other condition is needed or desired.

Although FIGS. 1A and 1B illustrate examples of systems 100 and 150 having shape-memory-based dead-facing mechanisms, various changes may be made to FIGS. 1A and 1B. For example, at least one circuit or system may include or be used in conjunction with any suitable number of shape-memory-based circuit interrupters 102. Also, each shape-memory-based circuit interrupter 102 may be used to interrupt a single electrical connection or multiple electrical connections depending on the implementation. In addition, the two example systems 100 and 150 shown here are merely meant to illustrate possible ways in which one or more shape-memory-based circuit interrupters 102 may be used. One or more shape-memory-based circuit interrupters 102 can be used in any other suitable manner.

Figure 2A:
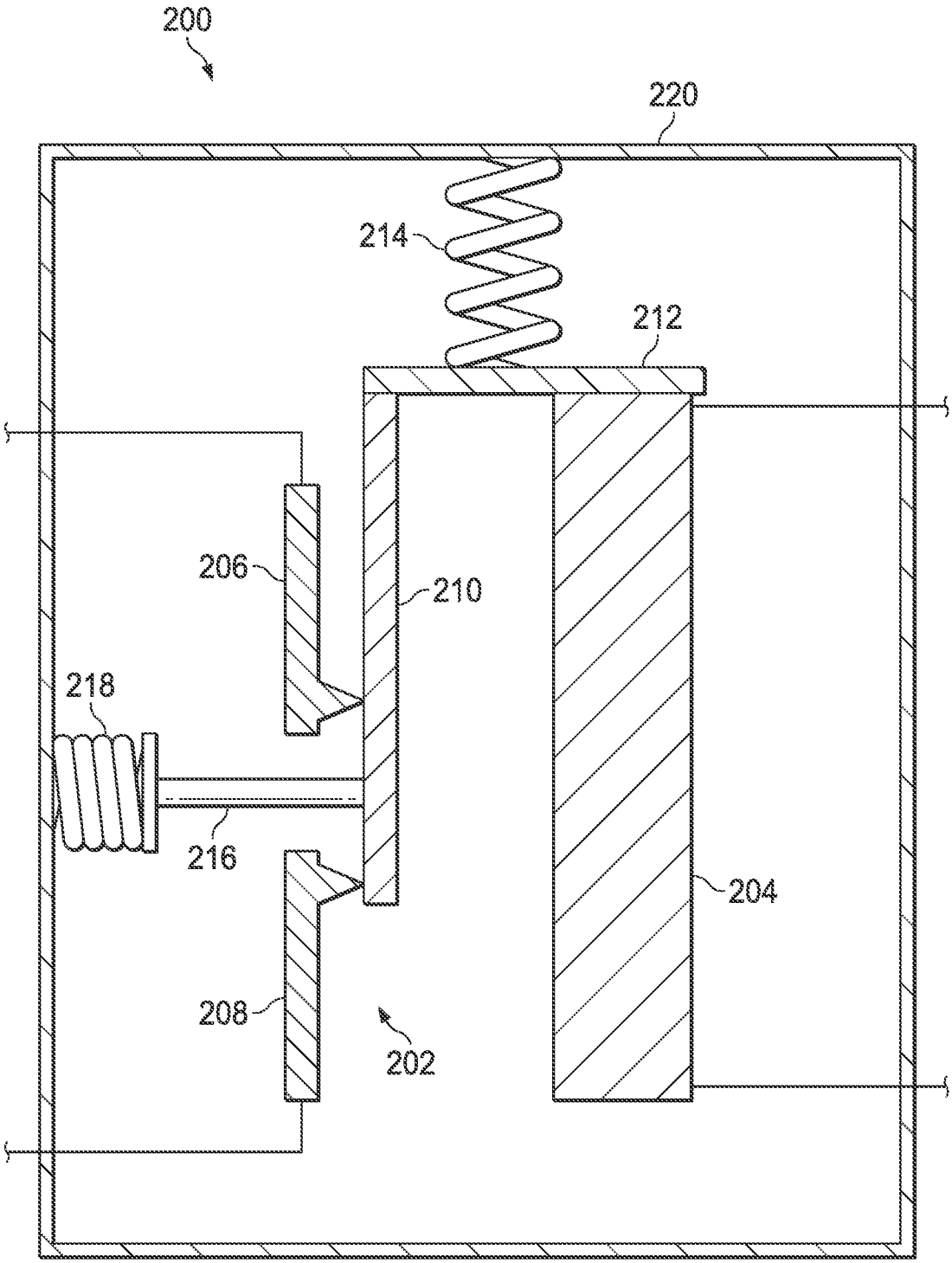
FIGS. 2A and 2B illustrate a first example shape-memory-based dead-facing mechanism for severing at least one electrical connection according to this disclosure.
Figure 2B:
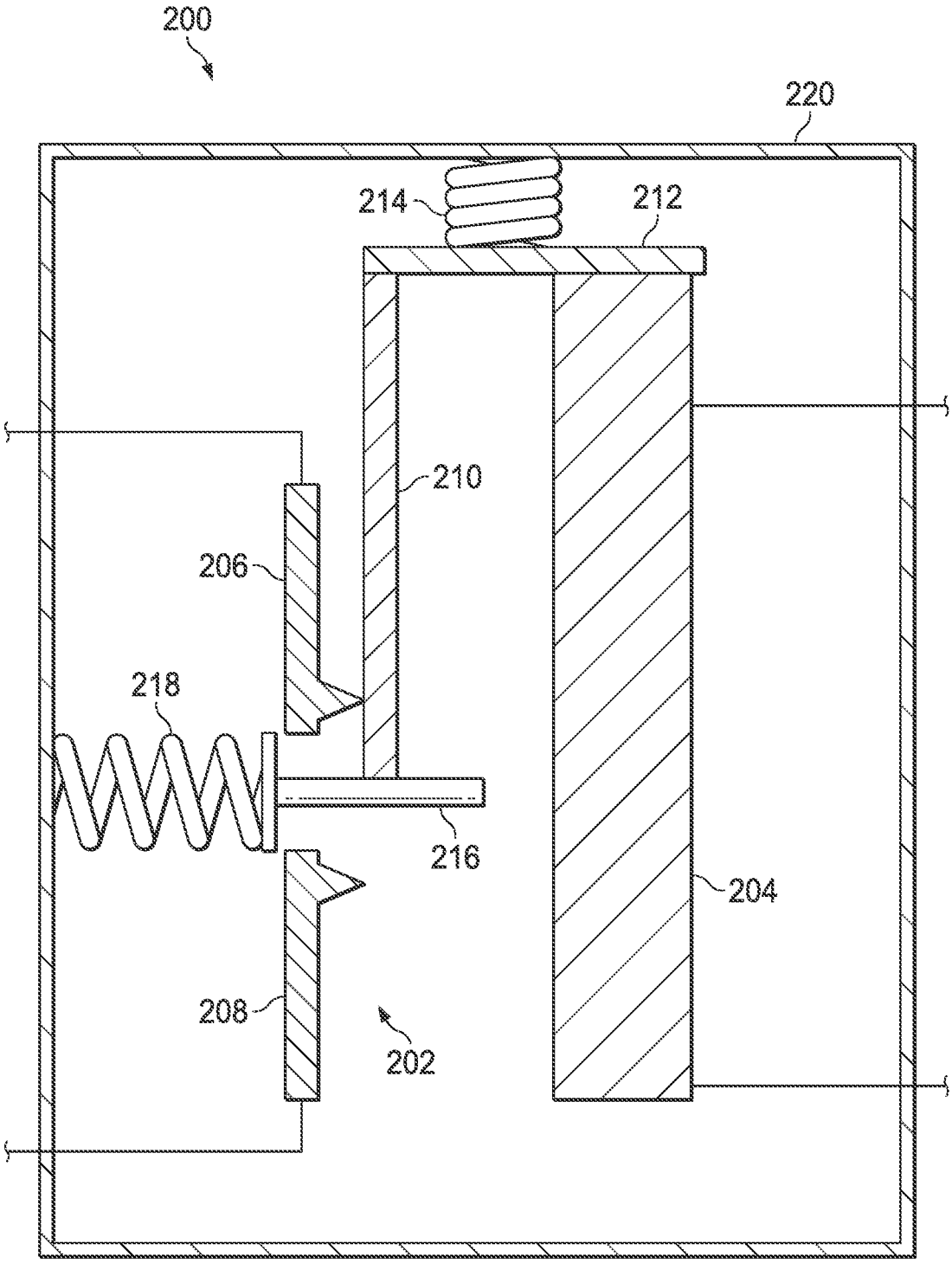

FIGS. 2A and 2B illustrate a first example shape-memory-based dead-facing mechanism 200 for severing at least one electrical connection according to this disclosure. The shape-memory-based dead-facing mechanism 200 shown in FIGS. 2A and 2B may, for example, represent one implementation of the shape-memory-based circuit interrupter 102 described above. For ease of explanation, the shape-memory-based dead-facing mechanism 200 of FIGS. 2A and 2B may be described as being used in the systems 100, 150 of FIGS. 1A and 1B. However, the shape-memory-based dead-facing mechanism 200 may be used in any other suitable manner.

As shown in FIGS. 2A and 2B, the shape-memory-based dead-facing mechanism 200 includes an electrical switch 202 and a shape-memory actuator 204. The electrical switch 202 generally operates to complete at least one electrical connection to, from, through, or between one or more circuits or systems prior to activation of the shape-memory actuator 204. Once the shape-memory actuator 204 is triggered, the electrical switch 202 breaks the at least one electrical connection, thereby providing dead-facing functionality.

In this example, the electrical switch 202 includes two stationary electrical contacts 206, 208 and a movable electrical contact 210. The stationary electrical contacts 206, 208 generally remain in place within the shape-memory-based dead-facing mechanism 200, while the movable electrical contact 210 can be repositioned within the shape-memory-based dead-facing mechanism 200. The movable electrical contact 210 is configured to bridge the stationary electrical contacts 206, 208 when in the appropriate position. This means that the movable electrical contact 210 can electrically connect the stationary electrical contacts 206, 208 when the movable electrical contact 210 is in the appropriate position.

Each stationary electrical contact 206, 208 can be formed from any suitable conductive material, such as copper, aluminum, or other suitable metal. Each stationary electrical contact 206, 208 can also be formed in any suitable manner. In addition, each stationary electrical contact 206, 208 can have any suitable size, shape, and dimensions. In this particular example, each of the stationary electrical contacts 206, 208 is generally implemented using a flat or planar structure coupled to or including a triangular contact point. However, this form of the stationary electrical contacts 206, 208 is for illustration only.

The movable electrical contact 210 can be formed from any suitable conductive material, such as copper, aluminum, or other suitable metal. The movable electrical contact 210 can also be formed in any suitable manner. In addition, the movable electrical contact 210 can have any suitable size, shape, and dimensions. In this particular example, the movable electrical contact 210 is generally implemented using a flat or planar structure. However, this form of the movable electrical contact 210 is for illustration only.

The shape-memory actuator 204 in this example represents or includes at least one piece of shape-memory material, such as a shape-memory metal or a shape-memory polymer, which may be positioned within a holding fixture. The holding fixture can constrain the shape changes of the shape-memory material and facilitate easy removal and re-insertion of the shape-memory material. The shape-memory actuator 204 is configured to change shape (such as via expansion or contraction) when triggered by the activation circuit 108. For example, the shape-memory material of the shape-memory actuator 204 changes shape when exposed to an elevated temperature, namely a temperature above the transition temperature of the shape-memory material. In the state shown in FIG. 2A, the shape-memory actuator 204 has not been triggered, so the movable electrical contact 210 remains in a position where the stationary electrical contacts 206, 208 are bridged. In the state shown in FIG. 2B, the shape-memory actuator 204 has been triggered, and the movable electrical contact 210 has been moved to a position where the stationary electrical contacts 206, 208 are no longer bridged. Thus, the shape-memory actuator 204 is able to selectively open the electrical switch 202 when triggered in order to sever at least one electrical connection formed using the electrical switch 202.

In this particular example, the shape-memory actuator 204 is attached to the movable electrical contact 210 indirectly via a connecting lift bar or lift element 212. The lift element 212 allows a force applied to the lift element 212 to be transferred to the movable electrical contact 210. As a result, when the shape-memory actuator 204 in this example pushes up against the lift element 212, both the lift element 212 and the movable electrical contact 210 can be repositioned upward. However, it should be noted that the use of the lift element 212 is not required, and the shape-memory actuator 204 may be coupled to the movable electrical contact 210 directly or via some other indirect coupling. The lift element 212 can be formed from any suitable material, such as a plastic or an insulation-coated metal (so that an electrical connection is not formed through the lift element 212). The lift element 212 can also be formed in any suitable manner. In addition, the lift element 212 can have any suitable size, shape, and dimensions. In this particular example, the lift element 212 is generally implemented using a flat or planar structure. However, this form of the lift element 212 is for illustration only.

As shown here, the lift element 212 is coupled to a spring 214, which applies a biasing force against the lift element 212. This biasing force helps to maintain the electrical switch 202 in the closed state by keeping the movable electrical contact 210 in position to bridge the stationary electrical contacts 206, 208. This also helps the electrical switch 202 to remain closed while resisting shock, vibrations, or other forces. However, the biasing force applied by the spring 214 can be overcome by the force applied by the shape-memory actuator 204, such as when the shape-memory actuator 204 expands in this example and pushes the lift element 212 upward. The spring 214 includes any suitable structure configured to apply a force that temporarily maintains an electrical switch 202 in a closed position.

A shutter member 216 can be positioned in the shape-memory-based dead-facing mechanism 200 between the stationary electrical contacts 206, 208. The shutter member 216 helps to reduce or prevent electrical arcs from forming between the stationary electrical contacts 206, 208. These electrical arcs may form if the voltage difference between the stationary electrical contacts 206, 208 exceeds the breakdown voltage of the air between the stationary electrical contacts 206, 208. In the example shown here, the shutter member 216 is positioned between the stationary electrical contacts 206, 208 and rests against the movable electrical contact 210 prior to triggering as shown in FIG. 2A. Once triggered, the movable electrical contact 210 is repositioned, and the shutter member 216 is extended further as shown in FIG. 2B. This extends the arc-gap between the stationary electrical contacts 206, 208, further reducing the likelihood of electrical arcs forming. Note that in the state shown in FIG. 2B, the shutter member 216 may or may not touch the movable electrical contact 210.

The shutter member 216 can be formed from any suitable material, such as a plastic or other electrically-insulative material. The shutter member 216 can also be formed in any suitable manner. In addition, the shutter member 216 can have any suitable size, shape, and dimensions. In this particular example, the shutter member 216 is generally implemented using a flat or planar structure. However, this form of the shutter member 216 is for illustration only.

As shown here, the shutter member 216 is coupled to a spring 218, which applies a biasing force against the shutter member 216 to keep the shutter member 216 in contact with the movable electrical contact 210. This biasing force helps to maintain the shutter member 216 between the stationary electrical contacts 206, 208. Once the movable electrical contact 210 is adequately repositioned, the biasing force applied by the spring 218 pushes the shutter member 216 further between the stationary electrical contacts 206, 208. The spring 218 includes any suitable structure configured to apply a biasing force.

A housing 220 can encase, support, or otherwise contain the various other elements of the shape-memory-based dead-facing mechanism 200. For example, the housing 220 may include internal compartments or structures configured to hold the stationary electrical contacts 206, 208 in place and to permit desired movement and restrain or prevent undesired movement of the shape-memory actuator 204, lift element 212, and shutter member 216. The housing 220 may also include openings or other passages for electrical connections to be formed to the interruptible circuit or system 104*a* or separable circuits or systems 104*b*-104*c* and to the activation circuit 108. Note that it is also possible for the activation circuit 108 (and possibly even the controller 114) to be positioned within the housing 220. The housing 220 can be formed from any suitable material, such as metal or ruggedized plastic. The housing 220 can also be formed in any suitable manner. In addition, the housing 220 can have any suitable size, shape, and dimensions.

It should be noted here that while the shape-memory actuator 204 is shown in FIGS. 2A and 2B as expanding to cause corresponding movement of the movable electrical contact 210 in the same direction, this is not required. For example, the shape-memory actuator 204 may be positioned above the lift element 212 in FIGS. 2A and 2B, where contraction of the shape-memory actuator 204 pulls the movable electrical contact 210 and opens the electrical switch 202. As another example, the lift element 212 may be replaced by a lever that pivots around a pivot point. The shape-memory actuator 204 may be designed to contract when exposed to an elevated temperature, so the shape-memory actuator 204 contracts in one direction and the movable electrical contact 210 moves in the opposite direction to open the electrical switch 202. As yet another example, the shape-memory actuator 204 may be positioned to the left of the movable electrical contact 210 in FIGS. 2A and 2B and be configured to expand and push the movable electrical contact 210 away from the stationary electrical contacts 206, 208 (to the right in these figures) to open the electrical switch 202. As still another example, the shape-memory actuator 204 may be positioned to the right of the movable electrical contact 210 in FIGS. 2A and 2B and be configured to contract and pull the movable electrical contact 210 away from the stationary electrical contacts 206, 208 (to the right in these figures) to open the electrical switch 202. In general, the shape-memory-based dead-facing mechanism 200 can include any suitable shape-memory actuator that causes movement to open an electrical switch (in any suitable manner whatsoever).

In order to reset the shape-memory-based dead-facing mechanism 200 (if and when needed), the shape-memory actuator 204 can be removed and re-compressed, re-expanded, or otherwise returned to its original shape. The shutter member 216 can be pushed back into a desired position, and the shape-memory actuator 204 can be re-inserted back into the shape-memory-based dead-facing mechanism 200. The movable electrical contact 210 can then be returned to its desired bridging position in contact with the shape-memory actuator 204. Of course, the specific manner of resetting the shape-memory-based dead-facing mechanism 200 can vary based on the design of the mechanism 200.

Although FIGS. 2A and 2B illustrate a first example of a shape-memory-based dead-facing mechanism 200 for severing at least one electrical connection, various changes may be made to FIGS. 2A and 2B. For example, various components in FIGS. 2A and 2B may be repositioned or reorganized as needed. Also, the relative sizes, shapes, and dimensions of the components in FIGS. 2A and 2B are for illustration only. Further, the shape-memory-based dead-facing mechanism 200 may include more than two stationary electrical contacts, and the stationary electrical contacts may be selectively bridged using one or more movable electrical contacts and selectively separated using one or more shutter members.

Figure 3A:
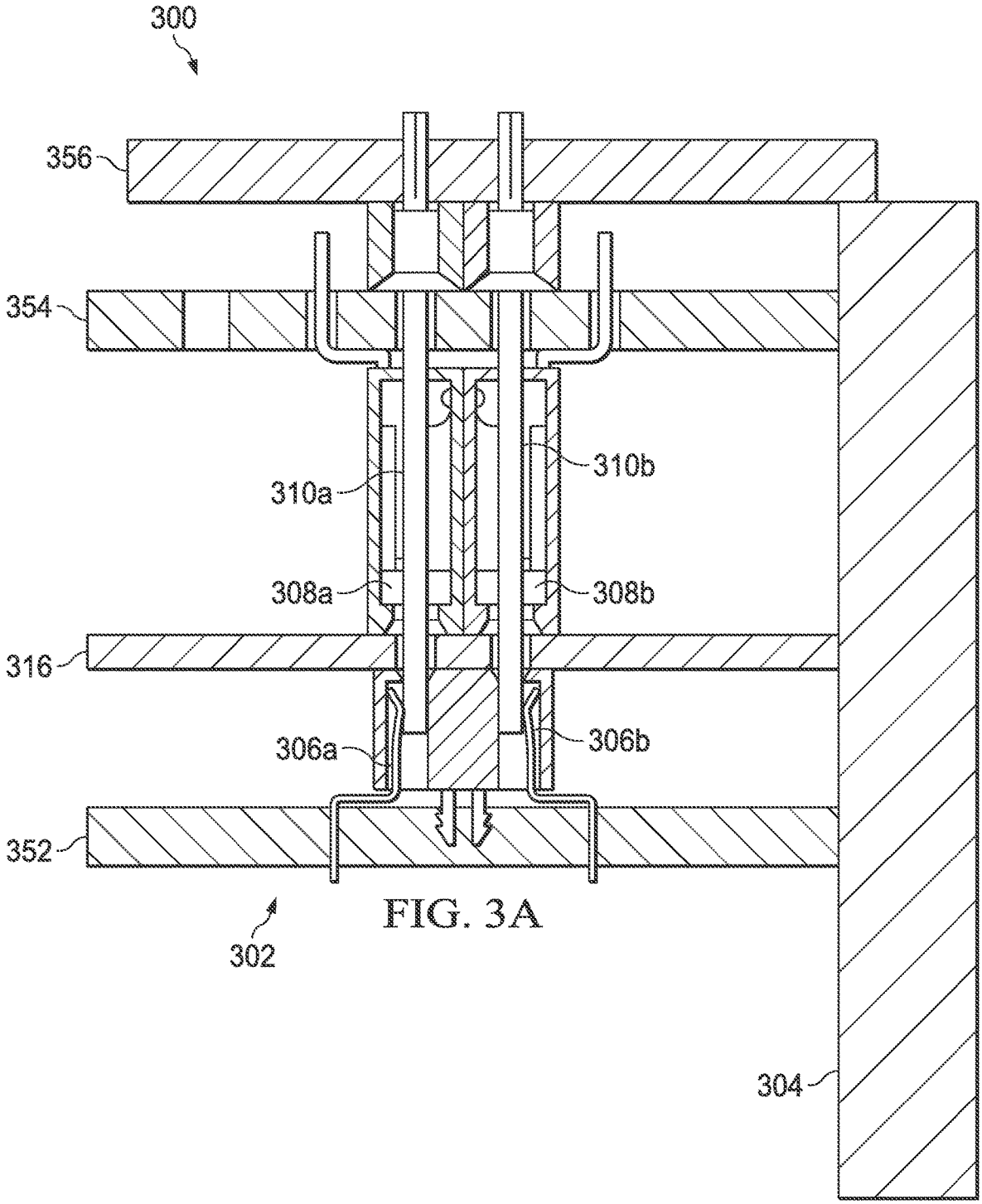
FIGS. 3A through 3C illustrate a second example shape-memory-based dead-facing mechanism for severing at least one electrical connection according to this disclosure.
Figure 3B:
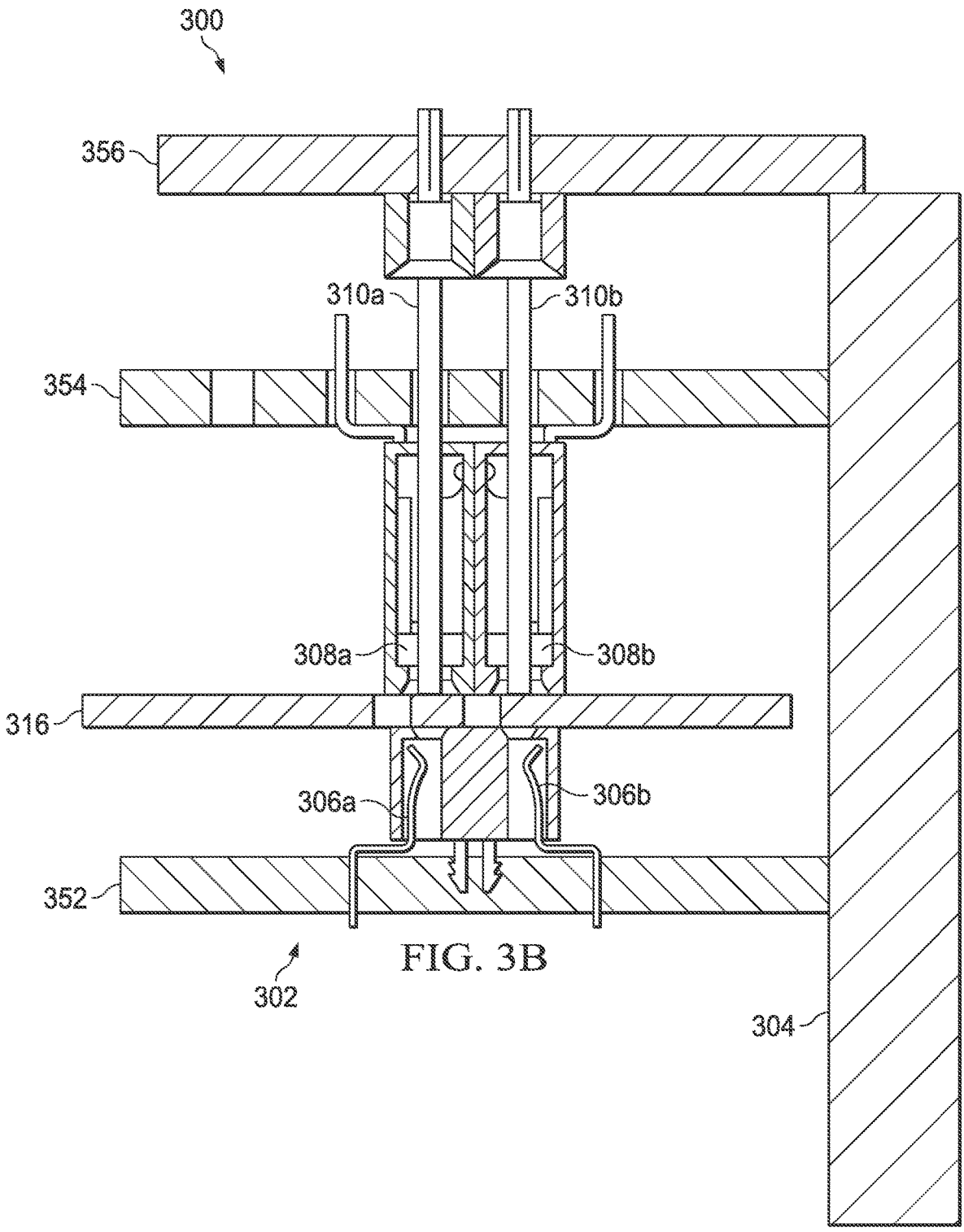
Figure 3C:
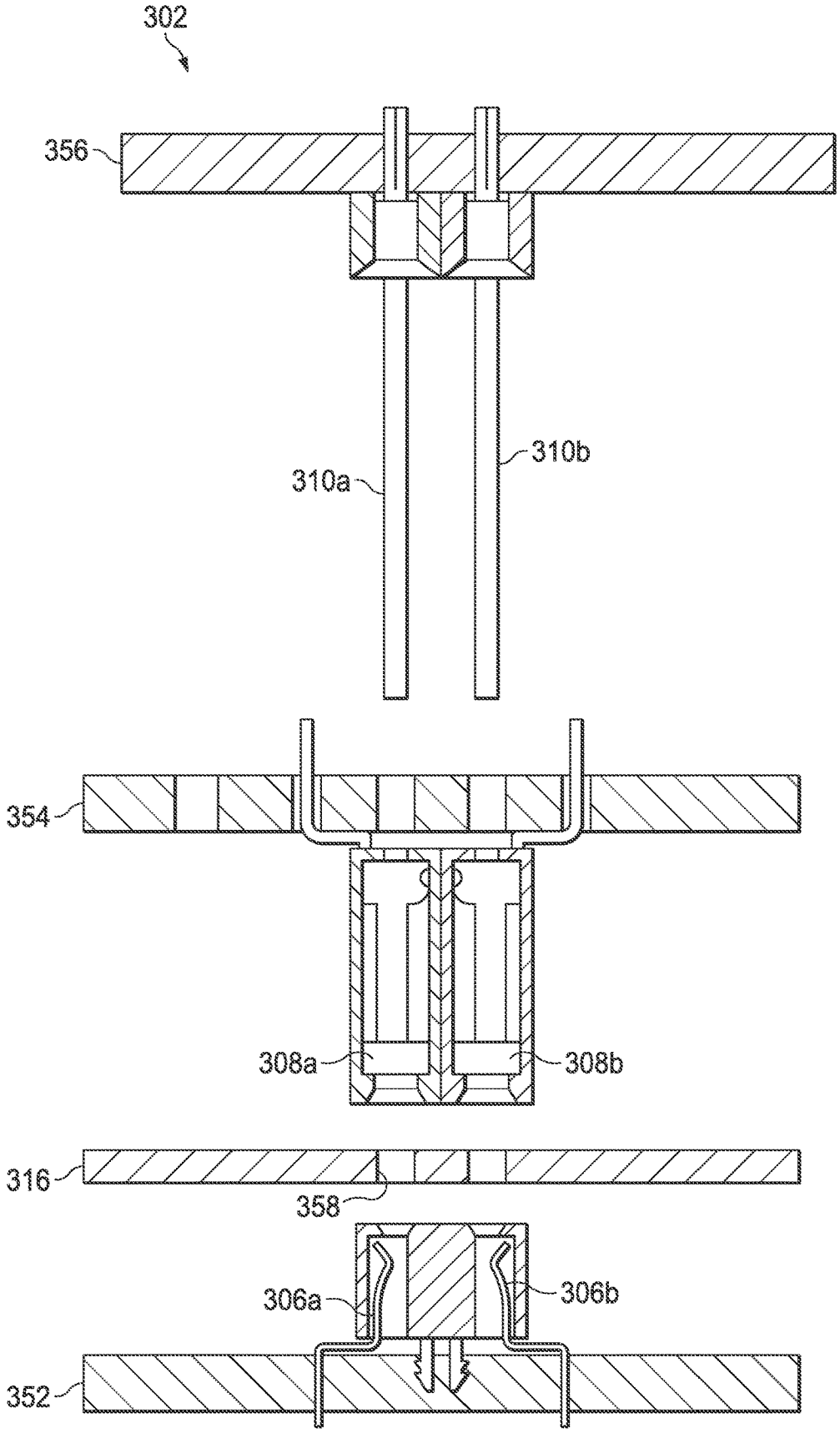

FIGS. 3A through 3C illustrate a second example shape-memory-based dead-facing mechanism 300 for severing at least one electrical connection according to this disclosure. The shape-memory-based dead-facing mechanism 300 shown in FIGS. 3A and 3B may, for example, represent another implementation of the shape-memory-based circuit interrupter 102 described above. For ease of explanation, the shape-memory-based dead-facing mechanism 300 of FIGS. 3A and 3B may be described as being used in the systems 100, 150 of FIGS. 1A and 1B. However, the shape-memory-based dead-facing mechanism 300 may be used in any other suitable manner. In this example, the shape-memory-based dead-facing mechanism 300 can be used to sever a single electrical connection or a pair of electrical connections, depending on what circuits or systems are coupled to the mechanism 300.

As shown in FIGS. 3A and 3B, the shape-memory-based dead-facing mechanism 300 includes an electrical switch 302 and a shape-memory actuator 304. An exploded view of the electrical switch 302 is shown in FIG. 3C. As shown here, the electrical switch 302 is formed using three substrates 352, 354, and 356. The substrates 352, 354, and 356 represent circuit boards or other suitable substrates configured to carry other components of the electrical switch 302. Each of the substrates 352, 354, and 356 may be formed from any suitable material, such as cotton paper, woven fiberglass, or woven glass and epoxy resin, carbon, metal, alumina or other ceramic, or polytetrafluoroethylene (PTFE), polyimide, polyester, or other polymer. Also, each of the substrates 352, 354, and 356 may be formed in any suitable manner, such as by using a single layer of material or by using multiple layers of material that are laminated or otherwise joined together. In addition, each of the substrates 352, 354, and 356 may have any suitable size, shape, and dimensions. In particular embodiments, each of the substrates 352, 354, and 356 may be about 0.063 inches (about 1.6 millimeters) thick, although other thicknesses may be used.

The substrate 352 carries a first pair of stationary electrical contacts 306*a*-306*b*, the substrate 354 carries a second pair of stationary electrical contacts 308*a*-308*b*, and the substrate 356 carries a pair of movable electrical contacts 310*a*-310*b*. When in the appropriate position, each movable electrical contact 310*a*-310*b* can bridge a pair of the stationary electrical contacts 306*a* and 308*a* or 306*b* and 308*b*. As a result, the electrical contacts 306*a*, 308*a*, and 310*a* can form a first electrical pathway through the electrical switch 302, and the electrical contacts 306*b*, 308*b*, and 310*b* can form a second electrical pathway through the electrical switch 302.

In some embodiments, the electrical contacts 306*a*-306*b*, 308*a*-308*b*, and 310*a*-310*b* represent or can be implemented using commercial off-the-shelf (COTS) products. For instance, the electrical contacts 306*a*-306*b* may represent an HLE series dual electrical socket from SAMTEC, INC. The electrical contacts 308*a*-308*b* may represent a BCS series dual pass-through electrical socket from SAMTEC, INC. The electrical contacts 310*a*-310*b* may represent an HMTWS series dual square post headers from SAMTEC, INC. Of course, the electrical switch 302 here can be fabricated in any other suitable manner using any suitable COTS or non-COTS components.

The shape-memory actuator 304 can be triggered using the activation circuit 108 or other suitable mechanism. In the state shown in FIG. 3A, the shape-memory actuator 304 has not yet been triggered, and the movable electrical contacts 310*a*-310*b* extend from the upper substrate 356 down through the stationary electrical contacts 308*a*-308*b* and into the stationary electrical contacts 306*a*-306*b*. This forms two closed electrical connections through the electrical switch 302 of the shape-memory-based dead-facing mechanism 300. In the state shown in FIG. 3B, the shape-memory actuator 304 has been triggered, and the shape-memory actuator 304 has pushed the substrate 356 (and thus the movable electrical contacts 310*a*-310*b*) away from the substrate 352. As a result, the movable electrical contacts 310*a*-310*b* no longer extend into the stationary electrical contacts 306*a*-306*b*. This opens the electrical switch 302 and breaks the two electrical connections.

A shutter member 316 is provided in the shape-memory-based dead-facing mechanism 300. The shutter member 316 in this example serves the same function as the shutter member 216 described above, namely helping to avoid the inadvertent re-bridging of the stationary electrical contacts 306*a*-306*b*, 308*a*-308*b* and to extend the arc-gap between the stationary electrical contacts 306*a*-306*b*, 308*a*-308*b*. In this example, the shutter member 316 is implemented as a generally flat structure having multiple holes 358, where each of the movable electrical contacts 310*a*-310*b* can pass through and be removed from one of the holes 358. The shutter member 316 can be biased (such as via the use of a spring) to push against the movable electrical contacts 310*a*-310*b* when in the state shown in FIG. 3A. Once the movable electrical contacts 310*a*-310*b* are removed from the holes 358, the shutter member 316 can be moved into the position shown in FIG. 3B.

Once again, it should be noted here that while the shape-memory actuator 304 is shown in FIGS. 3A and 3B as expanding to cause corresponding movement of the movable electrical contacts 310*a*-310*b* in the same direction, this is not required. For example, the shape-memory actuator 304 may be positioned above the substrate 356 in FIGS. 3A and 3B, where contraction of the shape-memory actuator 304 pulls the movable electrical contacts 310*a*-310*b* and opens the electrical switch 302. As another example, a lever that pivots around a pivot point may be attached to the substrate 356 and the shape-memory actuator 304, where the shape-memory actuator 304 contracts in one direction and the movable electrical contacts 310*a*-310*b* move in the opposite direction to open the electrical switch 302. In general, the shape-memory-based dead-facing mechanism 300 can include any suitable shape-memory actuator that causes movement to open an electrical switch (in any suitable manner whatsoever).

In order to reset the shape-memory-based dead-facing mechanism 300 (if and when needed), the shape-memory actuator 304 can be removed and re-compressed, re-expanded, or otherwise returned to its original shape. The shutter member 316 can be pushed back into a desired position, and the shape-memory actuator 304 can be re-inserted back into the shape-memory-based dead-facing mechanism 300. The movable electrical contacts 310*a*-310*b* can then be returned to their desired bridging position in contact with the shape-memory actuator 304. Of course, the specific manner of resetting the shape-memory-based dead-facing mechanism 300 can vary based on the design of the mechanism 300.

Although FIGS. 3A and 3B illustrate a second example of a shape-memory-based dead-facing mechanism 300 for severing an electrical connection, various changes may be made to FIGS. 3A and 3B. For example, various components in FIGS. 3A and 3B may be repositioned or reorganized as needed. Also, the relative sizes, shapes, and dimensions of the components in FIGS. 3A and 3B are for illustration only. Further, the shape-memory-based dead-facing mechanism 300 need not be used with two electrical connections and may be used with a single electrical connection or scaled higher to any suitable number of electrical connections (such as up to thirty-two electrical connections or even more).

Figure 4:
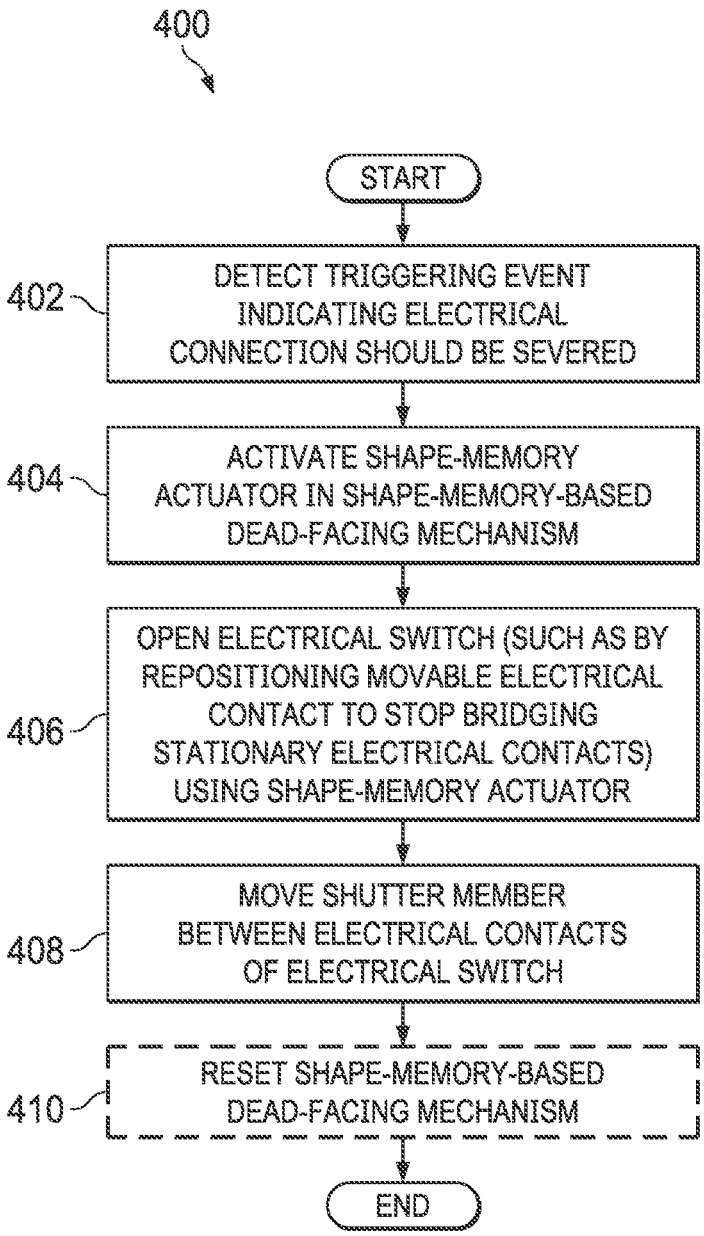
FIG. 4 illustrates an example method for using at least one shape-memory-based dead-facing mechanism to sever at least one electrical connection.

FIG. 4 illustrates an example method 400 for using at least one shape-memory-based dead-facing mechanism to sever at least one electrical connection according to this disclosure. For ease of explanation, the method 400 is described as involving the use of at least one shape-memory-based dead-facing mechanism 200 or 300 in the system 100 or 150 described above. However, the method 400 may involve any suitable shape-memory-based dead-facing mechanism or mechanisms designed in accordance with this disclosure in any suitable circuit, device, or system.

As shown in FIG. 4, a triggering event indicating that at least one electrical connection should be severed is detected at step 402. This may include, for example, the controller 114 detecting that a certain event or type of event has occurred. As noted above, the shape-memory-based dead-facing mechanisms in this disclosure can find use in a wide variety of applications, so the triggering event and the manner in which the triggering event is detected can vary widely. In response, at least one shape-memory actuator in at least one shape-memory-based dead-facing mechanism is activated at step 404. This may include, for example, the controller 114 closing the switch 112 in the activation circuit 108 or otherwise causing heating of the shape-memory material in the at least one shape-memory actuator 204, 304 of the at least one shape-memory-based dead-facing mechanism 200, 300.

The at least one shape-memory actuator opens at least one electrical switch in the at least one shape-memory-based dead-facing mechanism at step 406. This may include, for example, the at least one shape-memory actuator 204, 304 opening at least one electrical switch 202, 302 of the at least one shape-memory-based dead-facing mechanism 200, 300. As a particular example, this may include the at least one shape-memory actuator 204, 304 causing at least one movable electrical contact 210, 310*a*-310*b* of the at least one electrical switch 202, 302 to move into a position where the at least one movable electrical contact 210, 310*a*-310*b* no longer bridges stationary electrical contacts 206 and 208, 306*a*-306*b* and 308*a*-308*b*. At least one shutter member is moved between electrical contacts of the at least one electrical switch at step 408. This may include, for example, moving the shutter member 216 between (or further between) the stationary electrical contacts 206, 208 or moving the shutter member 316 between the stationary electrical contacts 306*a*-306*b* and 308*a*-308*b*.

At this point, one or more electrical connections have been severed using the at least one shape-memory-based dead-facing mechanism, and the at least one shutter member helps to prevent re-bridging of the stationary electrical contacts and to extend the arc-gap between the stationary electrical contacts. If needed or desired, the at least one shape-memory-based dead-facing mechanism can be reset at step 410. This may include, for example, returning each shape-memory actuator to its original shape, moving each shutter member to a desired position, and returning each movable electrical contact to a desired position.

Although FIG. 4 illustrates one example of a method 400 for using at least one shape-memory-based dead-facing mechanism to sever at least one electrical connection, various changes may be made to FIG. 4. For example, while shown as a series of steps, various steps in FIG. 4 can overlap, occur in parallel, or occur any number of times.

It may be advantageous to set forth definitions of certain words and phrases used throughout this patent document. The terms "include" and "comprise," as well as derivatives thereof, mean inclusion without limitation. The term "or" is inclusive, meaning and/or. The phrase "associated with," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, have a relationship to or with, or the like. The phrase "at least one of," when used with a list of items, means that different combinations of one or more of the listed items may be used, and only one item in the list may be needed. For example, "at least one of: A, B, and C" includes any of the following combinations: A, B, C, A and B, A and C, B and C, and A and B and C.

The description in the present application should not be read as implying that any particular element, step, or function is an essential or critical element that must be included in the claim scope. The scope of patented subject matter is defined only by the allowed claims. Moreover, none of the claims invokes 35 U.S.C. § 112(f) with respect to any of the appended claims or claim elements unless the exact words "means for" or "step for" are explicitly used in the particular claim, followed by a participle phrase identifying a function. Use of terms such as (but not limited to) "mechanism," "module," "device," "unit," "component," "element," "member," "apparatus," "machine," "system," "processor," or "controller" within a claim is understood and intended to refer to structures known to those skilled in the relevant art, as further modified or enhanced by the features of the claims themselves, and is not intended to invoke 35 U.S.C. § 112(f).

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. An apparatus comprising:

an electrical switch comprising (i) multiple first electrical contacts and (ii) a second electrical contact configured to bridge the first electrical contacts in order to form at least one electrical connection;

a shape-memory actuator configured to move the second electrical contact in order to selectively open the electrical switch and break the at least one electrical connection; and a shutter member configured to be moved into a position that blocks the second electrical contact from moving and re-bridging the first electrical contacts after the shape-memory actuator moves the second electrical contact;

wherein the shutter member is configured to be pushed against the second electrical contact prior to the shape-memory actuator moving the second electrical contact.

2. The apparatus of claim 1, wherein the shape-memory actuator is configured to be returned to an original shape, the shutter member is configured to be returned to an original position, and the second electrical contact is configured to be returned to a bridging position in order to reset the apparatus.

3. The apparatus of claim 1, wherein the shutter member is further configured to be moved between the first electrical contacts in order to extend an arc-gap between the first electrical contacts.

4. The apparatus of claim 1, further comprising a spring configured to apply a biasing force against the shutter member.

5. The apparatus of claim 1, further comprising:

a first substrate carrying at least one of the first electrical contacts;

a second substrate carrying at least one other of the first electrical contacts; and a third substrate carrying the second electrical contact;

wherein the second electrical contact extends from the third substrate, through the second substrate, through the at least one other of the first electrical contacts, and into the at least one of the first electrical contacts.

6. The apparatus of claim 1, further comprising a spring configured to apply a biasing force to keep the second electrical contact in a position where the second electrical contact bridges the first electrical contacts;

wherein the shape-memory actuator is configured to apply a force that overcomes the biasing force of the spring to reposition the second electrical contact.

7. The apparatus of claim 1, wherein:

the first electrical contacts comprise at least one pair of stationary electrical contacts; and the second electrical contact comprises at least one movable electrical contact.

8. A system comprising:

at least one electrical component coupled to one or more electrical connections; and at least one shape-memory-based circuit interrupter configured to selectively break the one or more electrical connections, wherein each shape-memory-based circuit interrupter comprises:

an electrical switch comprising (i) multiple first electrical contacts and (ii) a second electrical contact configured to bridge the first electrical contacts in order to form at least one of the one or more electrical connections;

a shape-memory actuator configured to move the second electrical contact in order to selectively open the electrical switch and break the at least one electrical connection; and a shutter member configured to be moved into a position that blocks the second electrical contact from moving and re-bridging the first electrical contacts after the shape, wherein the shutter member is configured to be pushed against the second electrical contact prior to the shape-memory actuator moving the second electrical contact.

9. The system of claim 8, wherein, in each shape-memory-based circuit interrupter, the shape-memory actuator is configured to be returned to an original shape, the shutter member is configured to be returned to an original position, and the second electrical contact is configured to be returned to a bridging position in order to reset the shape-memory-based circuit interrupter.

10. The system of claim 8, wherein, in each shape-memory-based circuit interrupter, the shutter member is further configured to be moved between the first electrical contacts in order to extend an arc-gap between the first electrical contacts.

11. The system of claim 8, wherein each shape-memory-based circuit interrupter further comprises a spring configured to apply a biasing force against the shutter member.

12. The system of claim 8, wherein each shape-memory-based circuit interrupter further comprises:

a first substrate carrying at least one of the first electrical contacts;

a second substrate carrying at least one other of the first electrical contacts; and a third substrate carrying the second electrical contact; and wherein the second electrical contact extends from the third substrate, through the second substrate, through the at least one other of the first electrical contacts, and into the at least one of the first electrical contacts.

13. The system of claim 8, wherein:

each shape-memory-based circuit interrupter further comprises a spring configured to apply a biasing force to keep the second electrical contact in a position where the second electrical contact bridges the first electrical contacts; and in each shape-memory-based circuit interrupter, the shape-memory actuator is configured to apply a force that overcomes the biasing force of the spring to reposition the second electrical contact.

14. The system of claim 8, wherein, in each shape-memory-based circuit interrupter:

the first electrical contacts comprise at least one pair of stationary electrical contacts; and the second electrical contact comprises at least one movable electrical contact.

15. The system of claim 8, wherein the at least one shape-memory-based circuit interrupter is configured to break the one or more electrical connections through at least one circuit that includes the at least one electrical component.

16. The system of claim 8, wherein the at least one shape-memory-based circuit interrupter is configured to break the one or more electrical connections between the at least one electrical component and at least one additional electrical component.

17. A method comprising:

forming at least one electrical connection through an electrical switch of a shape-memory-based circuit interrupter, the electrical switch comprising (i) multiple first electrical contacts and (ii) a second electrical contact configured to bridge the first electrical contacts in order to form the at least one electrical connection;

using a shape-memory actuator of the shape-memory-based circuit interrupter, moving the second electrical contact in order to selectively open the electrical switch and break the at least one electrical connection; and moving a shutter member into a position that blocks the second electrical contact from moving and re-bridging the first electrical contacts after the shape-memory actuator moves the, wherein the shutter member is pushed against the second electrical contact prior to the shape-memory actuator moving the second electrical contact.

18. The method of claim 17, further comprising:

resetting the shape-memory-based circuit interrupter by returning the shape-memory actuator to an original shape, returning the shutter member to an original position, and returning the second electrical contact to a bridging position.

19. The method of claim 17, wherein moving the shutter member further comprises moving the shutter member between the first electrical contacts in order to extend an arc-gap between the first electrical contacts.

20. The method of claim 17, further comprising:

detecting a triggering event; and activating the shape-memory actuator of the shape-memory-based circuit interrupter in response to the triggering event.

* * * * *